United States Patent [19]

Bucher et al.

[11] Patent Number: 4,811,762

[45] Date of Patent: Mar. 14, 1989

[54] WEFT YARN STORE FOR A LOOM

[75] Inventors: Robert Bucher, Frick; Paul Lincke, Kollbrunn, both of Switzerland

[73] Assignee: Sulzer Brothers Limited, Winterthur, Switzerland

[21] Appl. No.: 73,466

[22] Filed: Jul. 15, 1987

[30] Foreign Application Priority Data

Jul. 15, 1986 [CH] Switzerland ..... 2825/86

[51] Int. Cl.[4] ..... D03D 47/36

[52] U.S. Cl. ..... 139/452; 242/47.1

[58] Field of Search ..... 139/435, 452; 242/47.1

[56] References Cited

U.S. PATENT DOCUMENTS 4,516,611 5/1985 Mimura et al. .
4,607,668 8/1986 Tholander ..... 139/452
4,627,474 12/1986 Tholander .
4,651,786 3/1987 Griffith .

FOREIGN PATENT DOCUMENTS

0107110B1 9/1983 European Pat. Off. .
28552 2/1985 Japan ..... 139/452

*Primary Examiner*—Henry S. Jaudon
*Attorney, Agent, or Firm*—Burns, Doane, Swecker & Mathis

[57] ABSTRACT

A weft yarn store for a loom comprises a drum adapted to receive a weft yarn supply, a winder for winding weft yarn on the drum and means for retaining the weft yarn at the runoff end of the drum upon the completion of picking. A retaining element of the retaining means is adjustable by means of a controllable drive in the peripheral direction of the drum. When this element moves together with the running-off yarn during the braking thereof, the yarn can be retained smoothly. The weft yarn can therefore be metered accurately and smoothly.

8 Claims, 4 Drawing Sheets

WEFT YARN STORE FOR A LOOM

FIELD OF THE INVENTION AND BACKGROUND

The invention relates to looms and more particularly to weft yarn supply systems for looms. It deals particularly with a weft yarn store comprising a drum for taking up a supply of weft yarn; at least one winder for winding weft yarn from a package outside the store onto the drum; and means for retaining the weft yarn at the run-off end of the drum upon termination of picking.

European patent application No. 0 145 163 discloses a weft yarn store which detects the end of picking by a yarn stopper being moved into the path of the departing weft yarn so that departure thereof from the store ceases after a number of turns of yarn have been drawn off from the store. The winder drive is so controlled that a predetermined number of yarn windings are prepared on the drum periphery for each pick. The weft yarn store can meter the weft yarn accurately but yarn length can be varied for picking only in steps corresponding to a peripheral length of the drum. The diameter of the storage drum must be adapted to different weaving widths.

Another weft yarn store, disclosed by European patent application No. 0 107 110, provides an advantage in that it can provide various weft yarn lengths with the use of a constant-diameter drum by providing at the yarn draw-off end of the drum a number of elements for retaining the yarn at the end of picking. Weft yarn length can therefore be varied in steps corresponding to the spacing between the retaining elements on the drum periphery. This kind of store requires numerous mechanical elements to be disposed near the retaining means. The known means do not retain the weft yarn smoothly.

SUMMARY OF THE INVENTION

It is an object of this invention to provide a weft yarn store such that weft yarn length can be varied steplessly and a reduced number of moving mechanical parts are needed in the means for retaining the yarn at the end of picking, the yarn being braked smoothly.

According to the invention, therefore, a retaining element of the weft yarn retaining means can be adjusted in the peripheral direction of the drum by a controllable drive during operation, so that the length of the yarn running off the drum can be metered accurately. The drive is connected to a control coupled with a counter for counting the number of turns of weft yarn drawn off the store. The control can be connected to a picking detector for detecting the position of the weft yarn tip in the loom after picking and signals for adjusting the drive can be produced by the control in dependence upon the position of such tip.

Advantageously, the retaining element is in the form of a finger which can be actuated magnetically in the radial direction and which is received in a ring which extends around the drum at its yarn run-off end. The drive can be coupled with the ring and retaining element by way of a gear. If the control ring, retaining element and drive are provided in duplicate, the system can operate at half-speed.

The retaining element can be disposed in a cursor so mounted in a ring as to be drivable in rotation around the drum. The retaining element is actuatable by means of an electromagnet, a power supply and a control in the cursor, energization of the power supply and data transmission to the control being by way of windings in an electromagnetic drive in the ring and of a secondary winding in the cursor.

While a number of turns of yarn being drawn off the drum, the system is rotated on the drum periphery from one retaining position to a second position, so that fractions of turns of yarn can be drawn off. While the system is being adjusted, the retaining element can perform a number of revolutions on the drum periphery in the direction of rotation of yarn run-off. The retaining element accelerates to a speed close to the yarn run-off speed during the revolutions and is simultaneously made ready to catch the weft yarn, so that the weft yarn running off the drum runs against the retaining element gently and the device with the running-off weft yarn is then braked gradually or continuously.

The invention enables the weft yarn to be fed to the loom smoothly and without waste.

BRIEF DESCRIPTION OF THE DRAWINGS

The invention will be described in greater detail hereinafter with reference to the drawings wherein.

DETAILED DESCRIPTION OF PREFERRED EMBODIMENTS

Figure 1:
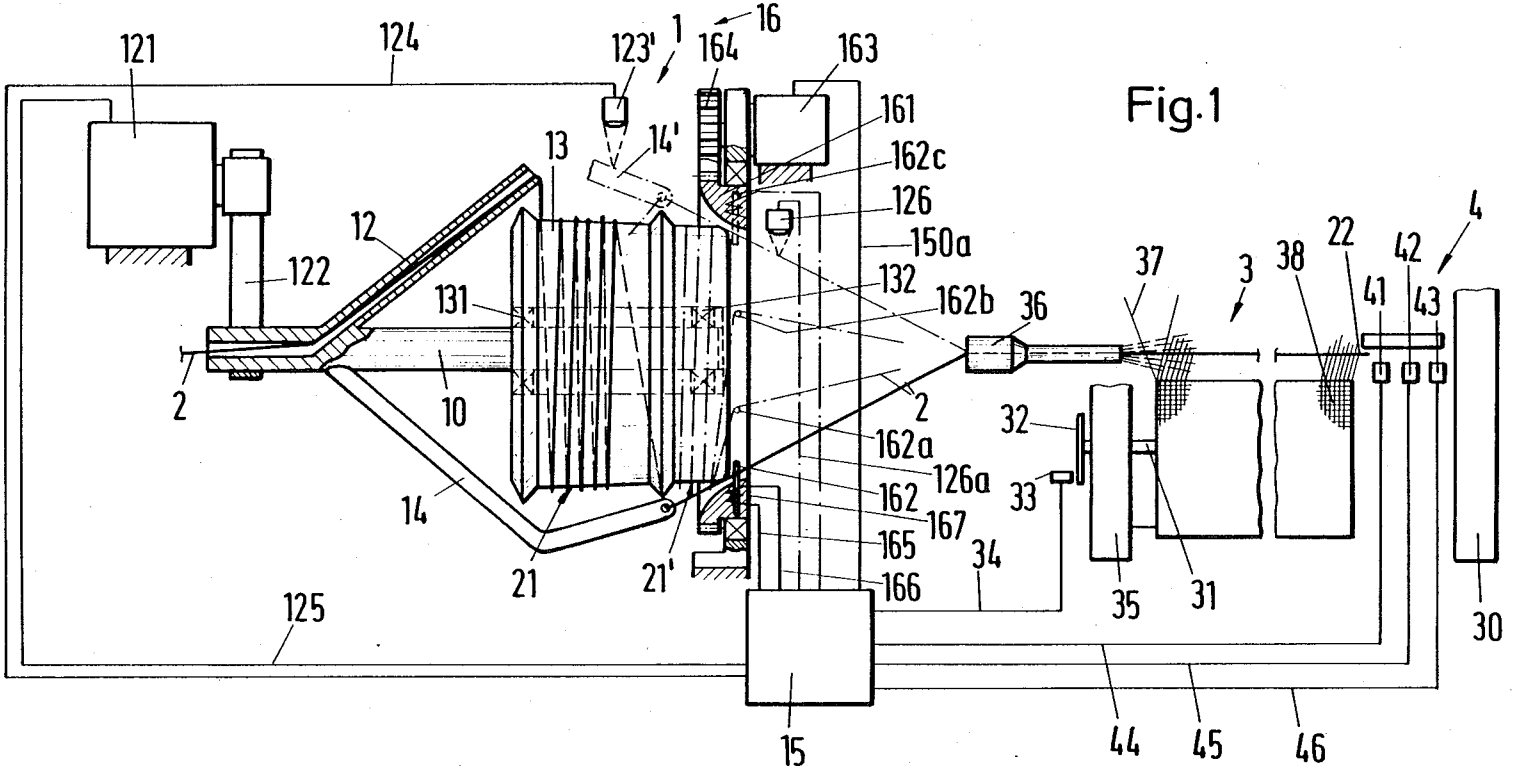
FIG. 1 shows a weft yarn store according to the invention and the passage of the yarn through the loom.
Figure 1A:
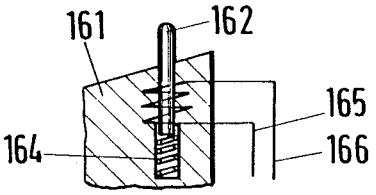
FIG. 1*a* shows as a detail of FIG. 1 the yarn-retaining element.

Referring to FIG. 1, a drum 13 of a weft yarn store 1 is mounted on a shaft 10 by way of bearings 131, 132. Weft yarn 2 is fed through a part of the shaft 10 to a winding arm 12 extending from the shaft 10 to the drum periphery. The weft yarn is deposited as supply 21 on the left-hand part of the drum 13, then rewound by a second winding arm 14 on to the right-hand part of the drum 13. A weft yarn supply 21' formed by the arm 14 is shown in chain-dotted lines.

A motor 121 acts by way of a driving belt 122 to rotate the shaft 10 and is connected to control 15. A winding detector 123' is operative to detect the number of revolutions made by the shaft 10 in a predetermined period of time. A signal line 124 connects the detector 123' to the control 15. Means 16 for controlling the yarn comprise: a drive 103 adapted to adjust on the drum periphery a ring 161 concentric with the drum 13; and a control element or retaining element 162 in the ring 161, the latter element thus being adapted to retain the yarn 2 running off the drum in various positions, such as 162*a*, 162*b* and 162*c*.

A yarn sensor 126 is operative to count the turns of yarn drawn off the store by a picking nozzle 36. The weft yarn is picked through shed 37 of loom 3 to picking detector 4 on the taking side 30 of the loom. The detector 4 can comprise these detectors 40–43 by way of control lines 44–46 to the control 15. After picking, the weft yarn 2 is beaten up on the edge of cloth 38. Loom frame 35 has mounted in it inter alia a main shaft 31 with an angle encoding disc 32. Reader 33 thereof transmits to the control 15 through line 34 signals relating to the operative state of the loom during a cycle thereof.

The operation of the store 1 will be described hereinafter. Before the store 1 comes into operation, the control 15 must be programmed in respect of the necessary length of weft yarn. The arms 12, 14 are so driven intermittently by the drive 121 that most of the required yarn length is pre-stored as supply 21' and the winding arm 14 has to unwind only a small proportion of the required length from the supply 21 during picking.

Picking is initiated from the store by the element 162 being withdrawn outwardly into the ring 161 by means of electromagnet 167, the same being energized through lines 165, 166, whereafter the picking nozzle 36 can draw the supply 21' off the drum periphery. The electromagnet 167 overcomes the pressure of the spring 164 tending to retain the element 162 in its extended position.

The sensor 126 counts the number of yarn turns drawn off during picking. If the required length of yarn is not an integral multiple of the drum periphery—i.e., of the length of one turn of yarn on the drum—the element 162 and, therefore, the ring 161 must, before moving out of the ring, be moved into a new position on the drum periphery.

This will be explained further with reference to a numerical example. It will be assumed that the required weft length is 3300 mm. Let the diameter of the drum 13 be 100 mm, so that the theoretical length of one turn of yarn on the drum periphery can be calculated as about 314 mm. A computer in the control 15 determines the number of turns of weft yarn to be drawn off for one pick. For the example chosen ten complete turns of yarn are required, corresponding to a total length of approximately 3140 mm. The 160 mm still required to make up the necessary yarn length correspond approximately to half a turn of yarn, more accurately to an arc length corresponding to an arc angle of 183.4° on the drum periphery. Consequently, between the initiation of picking upon the withdrawal of the element 162 and the termination of picking by the return of the element 162 into a fixed position within the circumferential gap between the drum 13 and the ring 161, the ring and the element 162 must be rotated through a further 183.4° in the direction of the departing weft yarn for the necessary approximately 10.5 turns of yarn to be drawn off the drum.

The control 15 must be able to determine the position of the element 162 relatively to the sensor 126 to ensure that the control element moves into the catching or taking position at the proper time. When the element 162 passes by the sensor 126 in its movement, in the numerical example chosen there are 11 passages of yarn past the sensor 126 during a single pick. The element 162 is withdrawn into the ring 161 to release the yarn 2 at a predetermined angle of rotation of the disc 32 while the extension of the element 162 to terminate picking is determined in dependence upon the number of times the weft yarn 2 passes by the sensor 126. The element 162 can be moved out into the taking position once the weft yarn has made its last passage past the element 162 during the drawing-off of the weft yarn. The control 15 determines the time.

The element 162 can be adjusted forwards or backwards from an original position diametrically opposite the sensor 126 through a maximum of 180°. However, the element 162 could be pivoted from any required position into its new position through a very reduced angle in the direction of yarn run-off or against such direction. Conveniently, a microprocessor is provided in the control 15 for yarn control functions and a controlled electric motor is used for the drive 103 of the ring 162.

The detectors 41–43 can detect weft yarn tip 22 in the taking mechanism 30 when the tip is in its end position. If the position of the tip 22 lies outside the range of tolerance after any pick, the control 15 can calculate a correction value for the position of the element 162 relatively to the drum 13 for one of the next picks, whereafter the position correction together with the computed adjustment difference is carried out by the drive 163.

Figure 2:
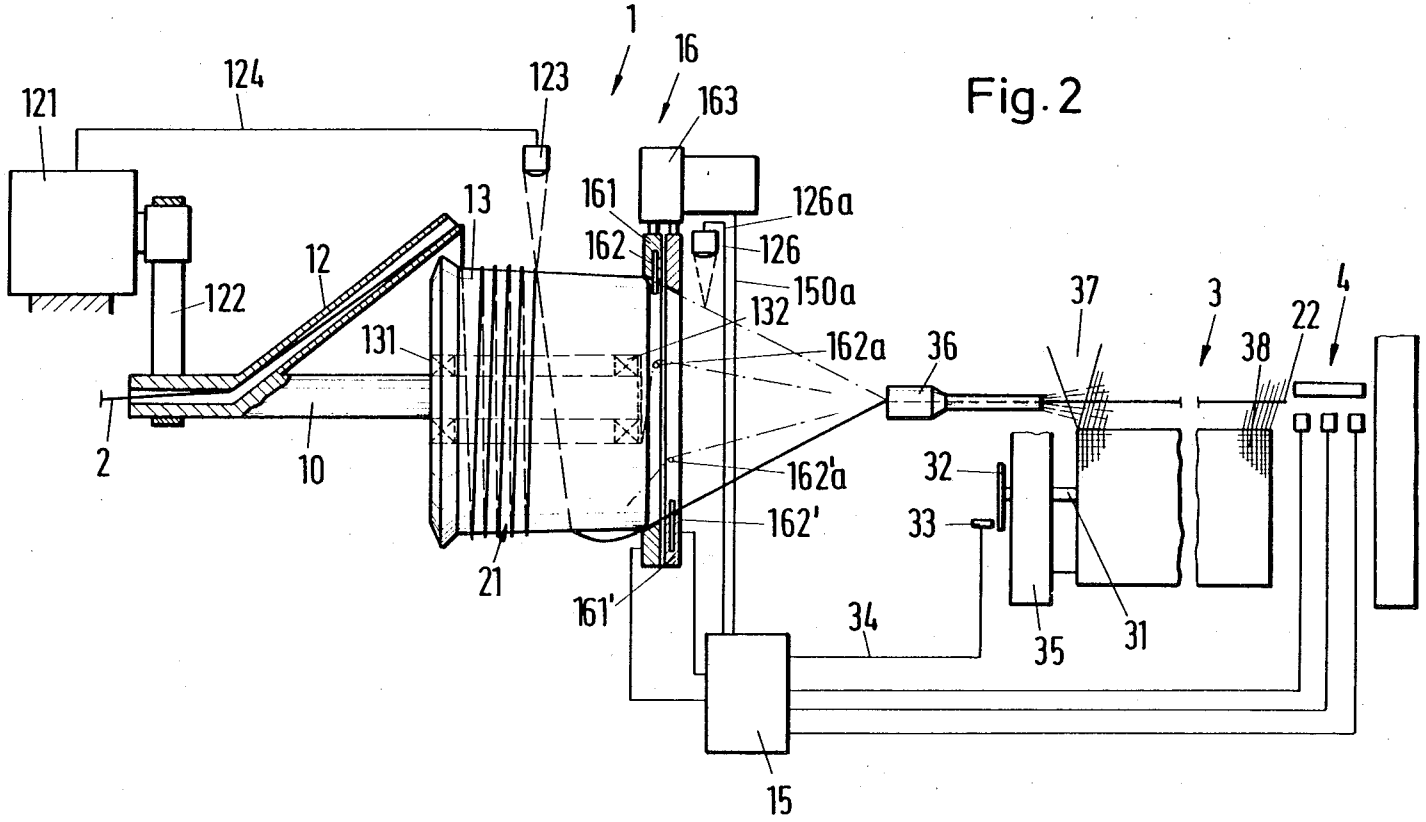
FIG. 2 shows another embodiment of the weft yarn store.
Figure 3:
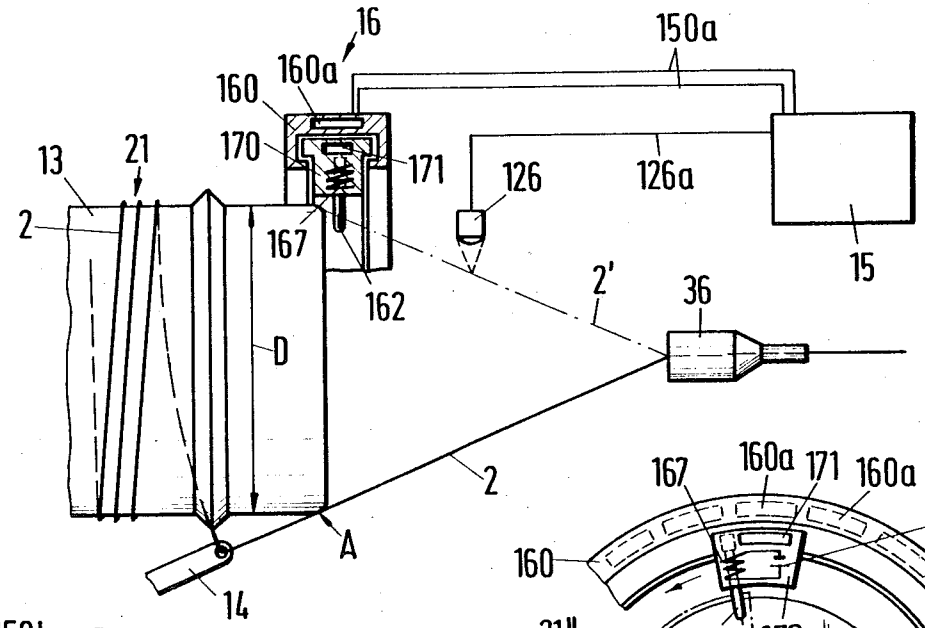
FIG. 3 is a partial view of another embodiment of a weft yarn store according to the invention.

FIG. 2 shows another embodiment of the weft yarn store according to the invention. In FIG. 2 only a single winding arm 12 is provided on the shaft 10 and produces a supply of weft yarn on the drum 13, formation of the supply being detected by a sensor 123, control line 124 and drive 121 of the shaft 10. The ring 160, 160' is in this construction provided in dual form. The two control or retaining elements 162, 162' can alternate with one another in their operation in this case so that twice the time for adjusting the control element 162, 162' is available between individual picks drawn off the store 1 as compared with the construction of FIG. 1.

Instead of rotating ring 161 as in FIG. 1, a cursor 170 in a stationary ring 160 can be used. This enables the drive for the retaining element 160 to be of very reduced mass. The ring 160 receives windings **160*a* in which, through the agency of the control 15 and control lines 150*a*, electromagnetic fields can be produced, the same rotating anticlockwise as initiated by an arrow 167 in FIG. 4. The cursor 170** has a magnetic insert on which the electromagnetic fields exert acceleration and deceleration forces and carrying or bearing forces.

Figure 5:
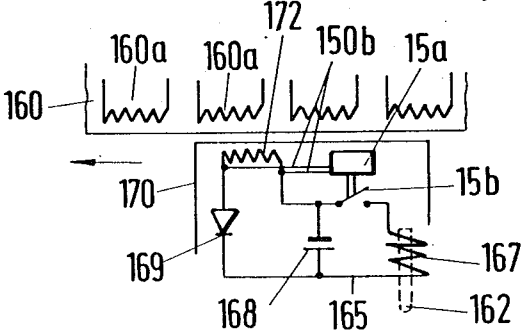
FIG. 5 is a diagrammatic view of the control of the retaining element of the embodiment of FIG. 3.

Whereas in FIG. 1 electric power is transmitted from lines 165,166 to the ring 161 by way of rubbing contacts, in the construction of FIG. 5 there is a non-contacting inductive supply of current from the windings **160*a* to the winding 172 in the cursor 170. Current flows through a rectifier 169 to a power supply 168 supplying the electromagnet 167 by way of the line 165 and a magnetic switch 15*b*, as can be seen in FIG. 5. A control 15*a* in the cursor 170 supervises the switch 15*b*. Data transmission from control 15 to control 15*a* to determine the time for energizing and de-energizing the electromagnet 167 also proceeds without contacting, by way of the windings 160*a* n the ring 160 and of the winding 172 in the cursor 170**.

When delicate weft yarns are being processed, it is convenient to move the retaining element 162 with its carrier, the ring 161 or cursor 170, together with the weft yarn towards the end of picking during taking, to ensure smooth braking of the weft yarn. It is assumed in the illustration of FIG. 4 that it is required to adjust the retaining element 162 clockwise through an angle $\beta$ between two yarn-retaining positions. It will be assumed that the position in which the element 162 is shown is its position at the end of the adjustment operation. To ensure smooth braking of the yarn, the retaining element 162 moves not directly, as indicated by an arrow $\beta$, from the old position into the new position, but, in the direction of movement indicated by an angle W, anticlockwise and in the direction of the yarn running off the drum.

Figure 6A:
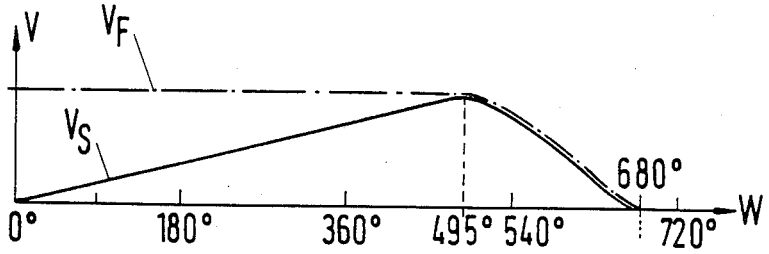
FIG. 6*a*–6*d* show the movement pattern of the weft yarn and retaining element plotted against the angle of rotation around the drum axis.

Shortly before the end of picking, the yarn supply 21' on the right-hand part of the drum 13 of FIG. 1 has been consumed, so that only yarn on the winding 21 is being unwound by the arm 14 and fed to the nozzle 36. As shown in FIG. 6*a*, the retaining element 162 moves from its old position into its new position at a speed $V_S$, moving through a total angle W=680° in its movement. It therefore makes substantially two complete revolutions around the periphery of the drum. The angle $\beta$ is therefore 40°. During the acceleration of the element 162, in which an angle W=495° is passed through, the yarn continues to unwind from the drum periphery at a constant draw-off speed $V_F$.

FIGS. 6*a*–6*d* illustrate the ideal state of synchronization of yarn and retaining element movements, since the weft yarn runs on to the retaining elements smoothly at an angle W=495°, whereafter the joint speed on the drum periphery up to the angle W=680° decreases gradually and smoothly to zero. During braking, the winder 14' of FIG. 4 overtakes the retaining element 162 so that a fresh yarn supply 21'' arises on the right-hand side of the drum 13, such fresh supply being unwound from the supply 21.

Figure 6B:
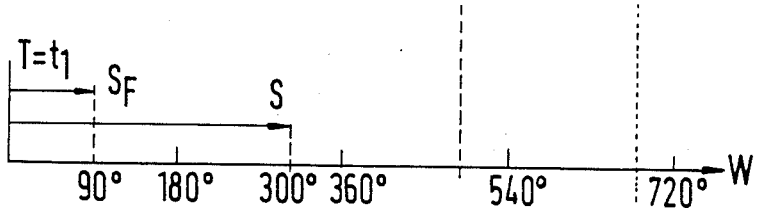
Figure 6C:
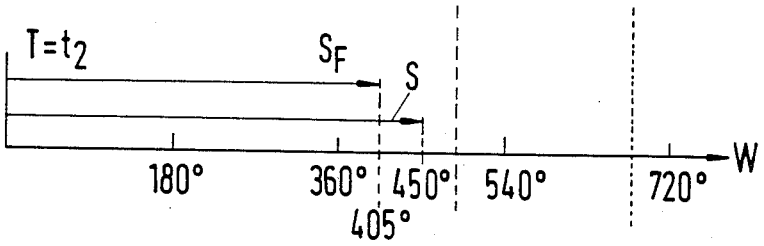
Figure 6D:
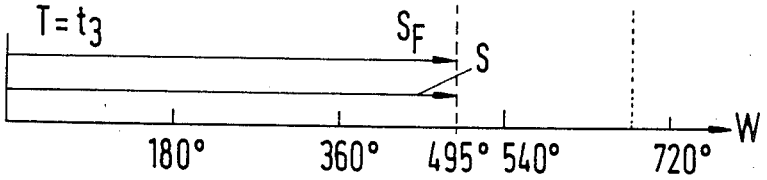

FIGS. 6*b*–6*d* show qualitatively the path S of the retaining element 162 on the drum periphery relatively to the path $S_F$ of the yarn in the phase when the retaining element 162 is moving. The aim is to show that throughout its movement the run-off position of the weft yarn from the right-hand edge A of the drum gradually catches up with retaining element 162 as far as the angle W=495°. The instants of time $T=t_1, t_2, t_3$, have been chosen arbitrarily.

During an actual adjustment angle $\alpha$ of the element 162 as measured in the direction of yarn rotation as it runs off the drum, (n+m) turns of the weft yarn having a total length of L (n+m) $\pi$ D are drawn off. In this expression:

m=the number of complete turns of yarn drawn off in the period between two retained positions, and $n=\alpha/360°$ where $\alpha$ denotes the angle through which the retaining element rotates on the drum periphery in the yarn run-off direction.

Figure 4:
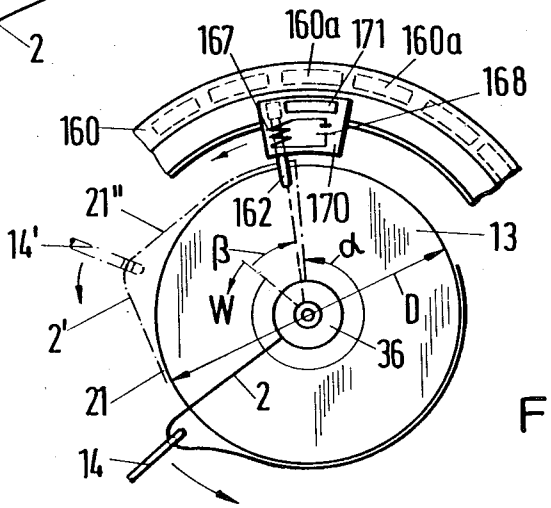
FIG. 4 is a view looking onto the store of FIG. 3 from the right and axially of the drum.

In FIG. 4 $\alpha+\beta=360°$. D denotes drum diameter.

Although certain embodiments have been illustrated and described in detail, it is intended that these be considered as exemplary and that the scope of the invention be ascertained from the following claims:

What is claimed is:

1. A weft yarn store for a loom, the store comprising: a drum for taking up a supply of weft yarn; at least one winder for winding weft yarn from a package outside the store onto the drum; and means for retaining the weft yarn at the run-off end of the drum upon the termination of picking, said means including a retaining element which is adjustable in the peripheral direction of the drum by a controllable drive during operation, so that the length of the yarn running off the drum can be metered accurately, said retaining element including a finger actuatable magnetically in the radial direction and received in a ring which extends around the drum at its yarn run-off end, said ring, retaining element and the associated drive being provided in dual form.

2. A weft yarn store for a loom, the store comprising: a drum for taking up a supply of weft yarn; at least one winder for winding weft yarn from a package outside the store onto the drum; a stationary ring extending around the axis of said drum at the discharge and thereof; and means for retaining the weft yarn at the run-off end of the drum upon the termination of picking, said means including a retaining element in a cursor mounted for movement relative to said stationary ring so as to be adjustable in the peripheral direction of the drum during operation; and controllable drive means for moving said retaining element about said ring so that the length of the yarn running off the drum can be metered accurately.

3. A store according to claim 2, wherein said retaining element is actuatable by means of an electromagnet, a power supply and a control, and wherein energization of said power supply and data transmission to said control are by way of windings in an electromagnetic drive in the ring and of a secondary winding in the cursor.

4. A method of operating a store according to claim 2 wherein the retaining element is so adjusted through an effective angle of rotation on the drum periphery during delivery of a weft yarn length L to the loom that (n+m) turns corresponding to a total length $L=(n+m)\pi D$ are drawn off the drum of diameter D between two retained postions of the weft yarn retaining means; where:

m=the number of complete turns of yarn drawn off in the period between two retained positions, and $n=\alpha/360°$ where $\alpha$ denotes the angle through which the retaining element rotates on the drum periphery in the yarn run-off direction.

5. A method according to claim 4, wherein the retaining element performs a number of revolutions on the drum periphery in the direction of rotation of yarn run-off during the adjustment operation between two retained positions.

6. A method according to claim 4, wherein the retaining element accelerates to a speed close to the yarn run-off speed during the revolutions and is simultaneously made ready to catch the weft yarn, so that the weft yarn running off the drum runs against the retaining element gently and the device with the running-off weft yarn is then braked smoothly to a stop.

7. A loom comprising picking means for inserting lengths of weft yarn into a shed at intervals; weft yarn package means for providing a source of weft yarn; and a weft yarn store interposed in the path of the weft yarn between said package means and said picking means; said store including a drum, means for winding weft yarn from said package means onto said drum, and means for controlling the passage of weft yarn off an end of said drum to said picking means; said means for controlling the passage of weft yarn from said drum including retaining means movable into the path of said yarn to prevent removal of yarn from said windings when said retaining means is actuated, and means for controlling the timing of actuation of said retaining means and the angular position of said retaining means about the axis of said drum to permit accurate metering of the length of weft yarn released from said drum during a picking cycle, said retaining means including a yarn contacting element mounted both for movement between a first radial position outside the path of said yarn and a second radial position which intersects the path of said yarn and for movement in a circumferential direction about the axis of said drum, and including means for controlling the extent of such movement in the circumferential direction in response to the desired length of a pick so that such length may exceed a whole multiple of the length of a winding on said drum by an amount equal to a fraction of the length of such a winding, and including drive means for moving said yarn contacting element in said circumferential direction during a picking operation in the same direction as the yarn is unwrapped from said drum and for slowing such movement to a stop after radial movement of said contacting element has brought it into the path of said yarn so that slowing of the circumferential movement of said contacting element slows movement of said yarn to minimize tension spikes in the yarn at the end of the picking operations.

8. A method of releasing weft yarn from a weft yarn store for picking into a loom, said weft yarn store being of a type in which a weft yarn is drawn off a package and wound onto a drum, and in which such weft yarn is removed from the drum at a run-off end of the drum according to the control of a yarn retaining element which is movable about the circumference of said drum periphery by a controllable drive and selectively actuatable in a radial direction between a first radial position in which it is located radially outwardly of the path of the yarn and a second radial position in which it is in the path of the yarn being removed from the drum; said method comprising moving said retaining element a number of revolutions about said drum periphery in the direction of rotation of yarn run-off during each picking operation while said element is in its first radial position by accelerating said element to a speed close to the yarn revolution speed about said drum during run-off, then actuating said retaining element to move it to its second radial position to catch the weft yarn, so that the weft yarn running off the drum runs against the retaining element gently, and then decelerating said retaining element so that the running-off weft yarn is braked smoothly to a stop.

* * * * *